US006814555B2

(12) United States Patent
Allen

(10) Patent No.: US 6,814,555 B2
(45) Date of Patent: Nov. 9, 2004

(54) APPARATUS AND METHOD FOR EXTRUDING SINGLE-COMPONENT LIQUID STRANDS INTO MULTI-COMPONENT FILAMENTS

(75) Inventor: Martin A. Allen, Dawsonville, GA (US)

(73) Assignee: Nordson Corporation, Westlake, OH (US)

( * ) Notice: Subject to any disclaimer, the term of this patent is extended or adjusted under 35 U.S.C. 154(b) by 468 days.

(21) Appl. No.: 09/802,646

(22) Filed: Mar. 9, 2001

(65) Prior Publication Data

US 2002/0125601 A1 Sep. 12, 2002

(51) Int. Cl.[7] ..... D01D 5/32

(52) U.S. Cl. ..... 425/72.2; 425/463; 425/DIG. 217; 425/131.5; 264/172.14

(58) Field of Search ..... 425/72.2, 463, 425/DIG. 217, 131.5; 264/172.14

(56) References Cited

U.S. PATENT DOCUMENTS

| | | | | |
|---|---|---|---|---|
| 2,374,540 A | | 4/1945 | Hall | 18/47.5 |
| 2,411,659 A | | 11/1946 | Manning | 154/9 |
| 2,411,660 A | | 11/1946 | Manning | 154/101 |
| 2,437,263 A | | 3/1948 | Manning | 264/115 |
| 2,508,462 A | | 5/1950 | Marshall | 18/8 |
| 3,387,327 A | * | 6/1968 | Privott, Jr. et al. | 425/131.5 |
| 3,601,846 A | | 8/1971 | Hudnall | 18/8 |
| 3,615,995 A | | 10/1971 | Buntin et al. | 156/161 |
| 3,671,379 A | * | 6/1972 | Evans et al. | 428/362 |
| 3,755,527 A | | 8/1973 | Keller et al. | 264/210 |
| 3,825,379 A | | 7/1974 | Lohkamp et al. | 425/72 |
| 3,825,380 A | | 7/1974 | Harding et al. | 425/72 |
| 3,841,953 A | | 10/1974 | Lohkamp et al. | 161/150 |
| 3,849,241 A | | 11/1974 | Burtin et al. | 161/169 |
| 3,895,151 A | | 7/1975 | Matthews et al. | 428/102 |

(List continued on next page.)

FOREIGN PATENT DOCUMENTS

| | | | |
|---|---|---|---|
| EP | 0088744 | | 9/1983 |
| EP | 0561612 A2 | | 9/1993 |
| EP | 1048760 A1 | | 11/2000 |
| FR | 2790487 | * | 8/2000 |
| JP | 45-2345 | | 1/1970 |
| JP | 50-90774 | | 12/1973 |
| JP | 55-142757 | | 4/1979 |
| JP | 57-176217 | | 1/1982 |
| JP | 2289107 | | 11/1990 |
| WO | WO99/48668 | * | 9/1999 |
| WO | 0212601 | | 2/2002 |

OTHER PUBLICATIONS

Vishal Bansal et al., *Metlblown Web*, U.S. Patent Publication No. 2002/0034909, Published on Mar. 21, 2002.

(List continued on next page.)

*Primary Examiner*—Robert Davis
*Assistant Examiner*—Joseph S Del Sole
(74) *Attorney, Agent, or Firm*—Wood, Herron & Evans, L.L.P.

(57) ABSTRACT

A melt spinning apparatus includes fiber producing features to produce multi-component filaments by extruding two or more single-component strands that combine after extrusion and are then attenuated by process air. The two or more liquid materials do not contact one another in the spinpack. Separation of the two types of liquid material throughout the spinpack prevents premature leakage between two liquid materials and allows for an optimized temperature for each type of liquid material for proper extrusion.

3 Claims, 6 Drawing Sheets

U.S. PATENT DOCUMENTS

| | | | | | |
|---|---|---|---|---|---|
| 3,949,130 | A | | 4/1976 | Sabee et al. | 428/192 |
| 3,981,650 | A | * | 9/1976 | Page | 425/72.2 |
| 4,145,518 | A | | 3/1979 | Morie et al. | 528/272 |
| 4,164,600 | A | | 8/1979 | Yung et al. | 428/198 |
| 4,181,640 | A | | 1/1980 | Morie et al. | 260/30.4 |
| 4,188,960 | A | | 2/1980 | Morie et al. | 131/267 |
| 4,217,387 | A | | 8/1980 | Viezee et al. | 428/288 |
| 4,238,175 | A | | 12/1980 | Fujii et al. | 425/83.1 |
| 4,267,002 | A | | 5/1981 | Sloan et al. | 156/276 |
| 4,357,379 | A | | 11/1982 | Sloan et al. | 428/113 |
| 4,426,417 | A | | 1/1984 | Meitner et al. | 428/195 |
| 4,437,869 | A | * | 3/1984 | Lecron et al. | 65/496 |
| 4,469,650 | A | | 9/1984 | Furukawa et al. | 156/62.4 |
| 4,547,420 | A | | 10/1985 | Krueger et al. | 428/229 |
| 4,560,385 | A | | 12/1985 | Baravian | 8/115.7 |
| 4,729,371 | A | | 3/1988 | Krueger et al. | 128/206.19 |
| 4,740,339 | A | * | 4/1988 | Bach et al. | 264/168 |
| 4,795,668 | A | | 1/1989 | Krueger et al. | 428/174 |
| 5,093,061 | A | * | 3/1992 | Bromley et al. | 264/172.14 |
| 6,057,256 | A | | 5/2000 | Krueger et al. | 442/400 |
| 6,103,181 | A | | 8/2000 | Berger | 264/555 |
| 6,182,732 | B1 | | 2/2001 | Allen | 156/441 |
| 6,402,870 | B1 | | 6/2002 | Groten et al. | 156/167 |
| 6,565,344 | B2 | * | 5/2003 | Bentley et al. | 425/72.2 |
| 2002/0034909 | A1 | * | 3/2002 | Bansal et al. | 442/361 |

OTHER PUBLICATIONS

Vishal Bansal et al., *Meltblown Web*, U.S. Patent Publication No. 2002/0037679, Published on Mar. 28, 2002.

Edgar N. Rudisill et al., *Process and Apparatus for Making Multi–Layered, Multi–Component Filaments*, U.S. Patent Publication No. 2002/0056940, Published on May 16, 2002.

*Handbook of Fibers Raw Materials*, 6 pgs.

C.Z. Carroll–Porczynski, *Inorganic Fibres*, London National Trade Press Limited 1958, 5 pgs.

Robert R. Buntin and Dwight T. Lohkamp, *Melt Blowing—A One–Step Web Process for New Nonwoven Products*. Article, vol. 56, No. 4, Apr. 1973 (4 pgs).

* cited by examiner

APPARATUS AND METHOD FOR EXTRUDING SINGLE-COMPONENT LIQUID STRANDS INTO MULTI-COMPONENT FILAMENTS

CROSS-REFERENCE TO RELATED APPLICATIONS

This application is related to the following commonly-owned application which was filed on even date herewith, namely U.S. Ser. No. 09/802,651, entitled "APPARATUS FOR PRODUCING MULTI-COMPONENT LIQUID FILAMENTS" now U.S. Pat. No. 6,565,344, and the disclosure of which is hereby incorporated by reference herein in its entirety.

FIELD OF THE INVENTION

The present invention generally relates to extruding two separate liquid materials into filaments or strands and, more particularly, to a melt spinning apparatus for spunbonding or meltblowing two separate liquid materials into multi-component filaments.

BACKGROUND OF THE INVENTION

Melt spun fabrics manufactured from synthetic thermoplastics have long been used in a variety of applications including filtration, batting, fabrics for oil cleanup, absorbents such as those used in diapers and feminine hygiene products, thermal insulation, and apparel and drapery for medical uses.

Melt spun materials fall in the general class of textiles referred to as nonwovens since they comprise randomly oriented filaments, or fibers, made by entangling the fibers through mechanical means. The fiber entanglement, with or without some interfiber fusion, imparts integrity and strength to the fabric. The nonwoven fabric may be converted to a variety of end use products as mentioned above.

Although melt spun nonwovens may be made by a number of processes, the most popular processes are meltblowing and spunbond processes, both of which involve melt spinning of thermoplastic material. Meltblowing is a process for the manufacture of a nonwoven fabric wherein a molten thermoplastic is extruded from a die tip to form a row of filaments. The fibers exiting the die tip are immediately contacted with converging sheets or jets of hot air to stretch or draw the filaments down to microsize diameter. The fibers are then deposited onto a collector in a random manner and form a nonwoven fabric.

The spunbond process involves the extrusion of continuous filaments through a spinneret. The extruded filaments are maintained apart and the desired orientation of the filaments is achieved, for example, by electrical charges, by controlled air streams, or by the speed of the collector. The filaments are collected on the collector and bonded by passing the layer of filaments through compacting roll and/or hot roll calendaring.

Nonwoven materials are used in such products as diapers, surgical gowns, carpet backings, filters and many other consumer and industrial products. The most popular machines for manufacturing nonwoven materials use meltblown and spunbond apparatus. For certain applications, it is desirable to utilize multiple types of thermoplastic liquid materials to form individual cross-sectional portions of each filament. Often, these multi-component filaments comprise two components and, therefore, are more specifically referred to as bicomponent filaments. For example, when manufacturing nonwoven materials for use in the garment industry, it may be desirable to produce bicomponent filaments having a side-by-side construction. One important consideration involves the cost of the material. For example, one strand of inexpensive material may be combined with a strand of more expensive material. The first strand may be formed from polypropylene or nylon and the other strand may be formed from a polyester or co-polyester. In addition, the two types of material may contract a different amount when drying or cooling, creating a curly filament with desirable properties.

Many other multi-component fiber configurations exist, including sheath-core, tipped, and microdenier configurations, each having its own special applications. Various material properties can be controlled using one or more of the component liquids. These include, as examples, thermal, chemical, electrical, optical, fragrance, and anti-microbial properties. Likewise, many types of die tips exist for combining the multiple liquid components just prior to discharge to produce filaments of the desired cross-sectional configuration.

Various apparatus form bi-component filaments with a die tip comprising vertically or horizontally stacked plates. In particular, a melt blowing die tip directs two flows of liquid material to opposing sides near the top of a stack of the vertical plates. A spunbond die tip directs two different material flows to the top plate of a stack of horizontal plates. Liquid passages etched or drilled into the vertical or horizontal stack of plates direct the two different types of liquid material to a location at which they are combined within the die tip and then extruded at the discharge outlets as multi-component filaments. Various cross-sectional configurations of filaments are achieved, such as side-by-side and sheath-core configurations.

Using a stack of thin plates in either a vertical or horizontal orientation manner suffers from imperfect seals between plates. In a production environment, liquid pressure will cause adjacent plates to move slightly away from each other. Thus, small amounts of liquid of one type can leak through these imperfect seals, causing "shot" or small balls of polymer to be formed in the extruded filaments. The shot causes the multi-component filaments to form with problems such as reduced strength or increased roughness. Also, the stacked plates may not offer a substantial thermal barrier between the two types of liquid material. Consequently, the filaments of each liquid material may not combine at their respective optimum temperatures, possibly adversely affecting extrusion thereof.

Other apparatus avoid the use of stacked plates by having the two types of liquid material combine in a cavity prior to extrusion of the through multiple discharge passages. More specifically, two different types of liquid materials, such as thermoplastic polymers, initially reside side-by-side in the cavity and are delivered under pressure to the discharge passages where they are extruded in side-by-side relation as bicomponent filaments. Since the two liquid materials reside in side-by-side relation in the die cavity and discharge passages, this may lead to thermal problems or problems related to the materials improperly combining or mixing prior to extrusion.

For these reasons, it is desirable to provide apparatus and methods for melt spinning multi-component filaments without encountering various problems of prior melt spinning apparatus.

SUMMARY OF THE INVENTION

The present invention provides methods and apparatus for melt spinning multiple types of liquid materials into multi-component filaments. This includes, for example, melt spinning apparatus and methods related to meltblown and spunbond applications. In particular, a spinpack or die tip of a melt spinning apparatus produces multi-component filaments by extruding two single-component filaments from a die tip that combine after extrusion to thereby form multi-component filaments. The two liquid materials do not contact one another until after each is extruded through a separate orifice in the die tip. Maintaining the separation of the two types of liquid material throughout the spinpack prevents premature leakage between two liquid flows and allows for maintaining an optimized temperature for each type of liquid material for proper extrusion.

The method of this invention produces multi-component filaments by extruding a first strand of a first type of liquid material and simultaneously extruding a second strand of a second type of liquid material. The two strands combine together after the extrusion of each and thereby form a multi-component filament, for example, having essentially a side-by-side cross-sectional configuration of the two component materials.

The melt spinning apparatus of this invention comprises a die tip having a first liquid input configured to communicate with a supply of the first type of liquid material and having a second liquid input configured to communicate with a supply of the second type of liquid material. The die tip further includes first outlets or orifices for extruding first strands of the first type of liquid material and second outlets or orifices for extruding second strands of the second type of liquid material. Each first outlet is adjacent to a corresponding one of the second outlets for extruding respectively the first and second strands that combine together after extrusion into a multi-component filament.

Various advantages, objectives, and features of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

For purposes of this description, words such as "vertical", "horizontal", "bottom", "right", "left" and the like are applied in conjunction with the drawings for purposes of clarity. As is well known, melt spinning devices may be oriented in substantially any orientation, so these directional words should not be used to imply any particular absolute directions for a melt spinning apparatus consistent with the invention. In addition, the terms "different", "two types", and similar terminology with regard to the liquids employable with this invention are not meant to be restrictive, except to the extent that the two liquids have one or more different properties. The liquids may be the same polymer, for example, but have different physical properties due to different treatments.

Post-extrusion combining of two single-component strands into a multi-component filament avoids physical interaction or contact between the different types of liquid materials before extrusion. The strands are urged together by the direction of their extrusion. In the case of a meltblown application of this invention, the impingement of process air may also assist in urging the two strands of the different materials into a multi-component filament. The complete physical separation prior to extrusion prevents any leakage between the flow of different liquid materials that cause defects such as "shot" to form in one of the constituent liquid materials. Moreover, the flows are physically separated in the spinpack to provide thermal isolation between types of liquids that are to be extruded at different temperatures.

Figure 1:
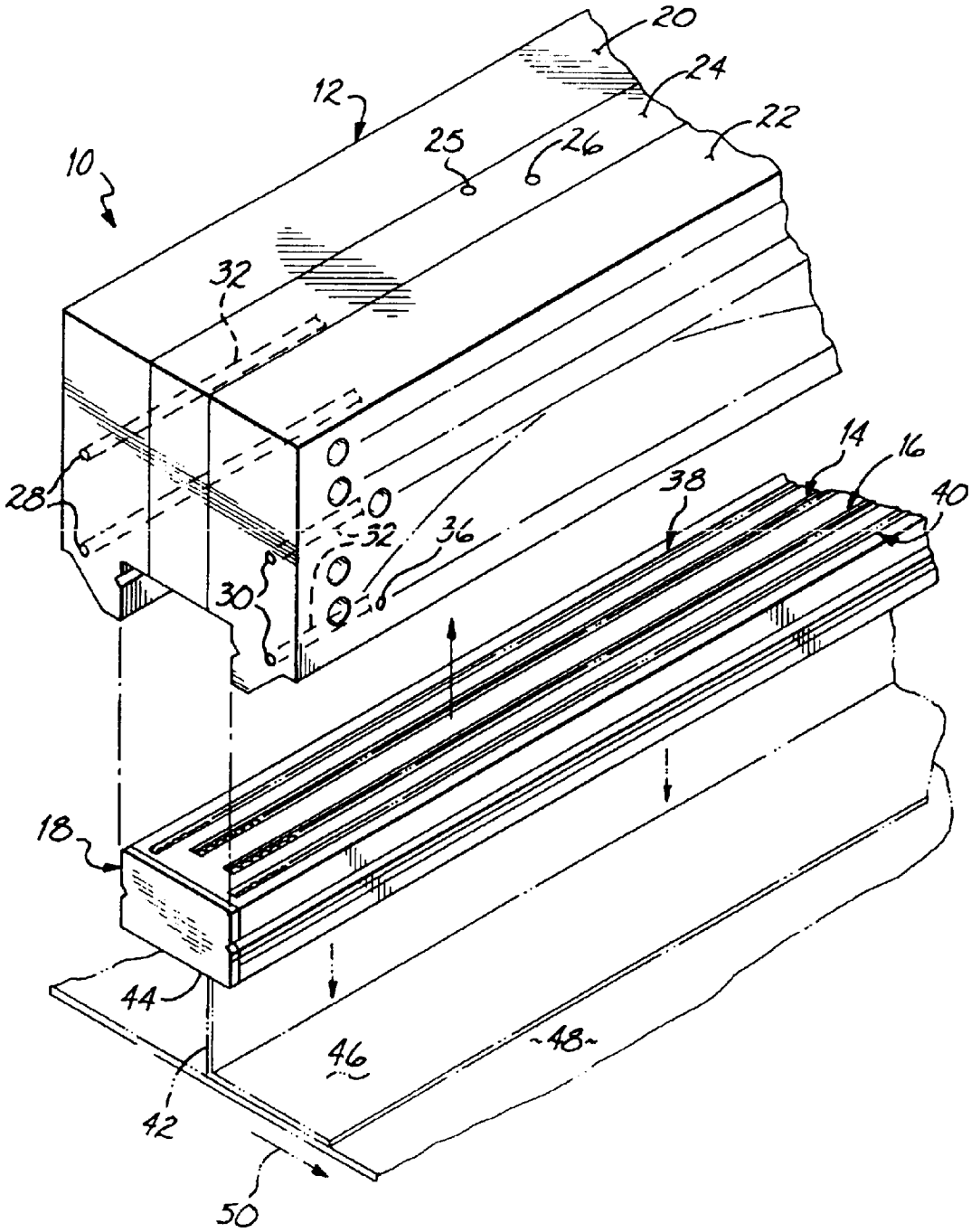
FIG. 1 is an exploded perspective view of a multi-component melt spinning apparatus constructed in accordance with the invention.

With reference to FIG. 1, a melt spinning assembly 10 constructed in accordance with the inventive principles includes a manifold assembly 12 for supplying two types of liquid material (polymer A and polymer B) respectively to liquid inputs 14, 16 of a spinpack 18. The inputs 14 and 16 are sealed to the manifold assembly 12 such as by static seals retained within recesses (not shown) around each input 14, 16.

The manifold assembly 12 includes first and second outer manifold elements 20, 22. An intermediate manifold element 24 is coupled between outer manifold elements 20, 22 in sandwiching relation. An upper surface of intermediate manifold element 24 includes first and second liquid supply inlets 25, 26 that receive polymers A and B respectively from liquid supplies, such as liquid pumps (not shown). Each supply inlet 25 communicates with a recess (not shown) formed between outer manifold element 20 and intermediate manifold element 24. The recess forms a "coat hanger" shape to form a first manifold liquid passage to provide liquid to at least a portion of the longitudinal length of liquid input 14 of the spinpack 18. Similarly, supply inlet 26 communicates with a recess (not) shown formed between outer manifold element 22 and intermediate manifold element 24. The recess forms another "coat hanger" shape to form a second manifold liquid passage to provide liquid to at least a portion of the longitudinal length of liquid input 16 of the spinpack 18. The manifold assembly 12 may include a plurality of supply inlets 25, 26 and corresponding first and second manifold liquid passages along its longitudinal length depending on the length of the spinpack 18.

Holes 28 and 30 located along the length of each outer manifold element 20, 22 each receive a heating device, such as an electrical heater rod 32 for independently heating the two liquids in their respective first and second manifold liquid passages and the process air to an appropriate application temperature. Temperature sensing devices (not shown), such as resistance temperature detectors (RTDs) or thermocouples are also placed in outer manifold elements 20, 22 to independently control the temperature of each type of liquid material.

It should be appreciated by those skilled in the art having the benefit of the present disclosure that various heating systems consistent with aspects of the invention may be appropriately used in different applications.

Outer manifold elements 20, 22 further include a plurality of air supply passages 34, 36 for supplying pressurized air (process air) to air passage inputs 38, 40 of the spinpack 18. The process air attenuates multi-component filaments 42 extruded along the longitudinal length of the spinpack 18 from a row of multi-component filament discharge outlets 44 (see depictions in FIGS. 3–5). The attenuated multi-component filaments 42 form a nonwoven fabric 46 upon a substrate 48 that generally is moving transverse to the melt spinning apparatus 10, such as shown by arrow 50.

Figure 2:
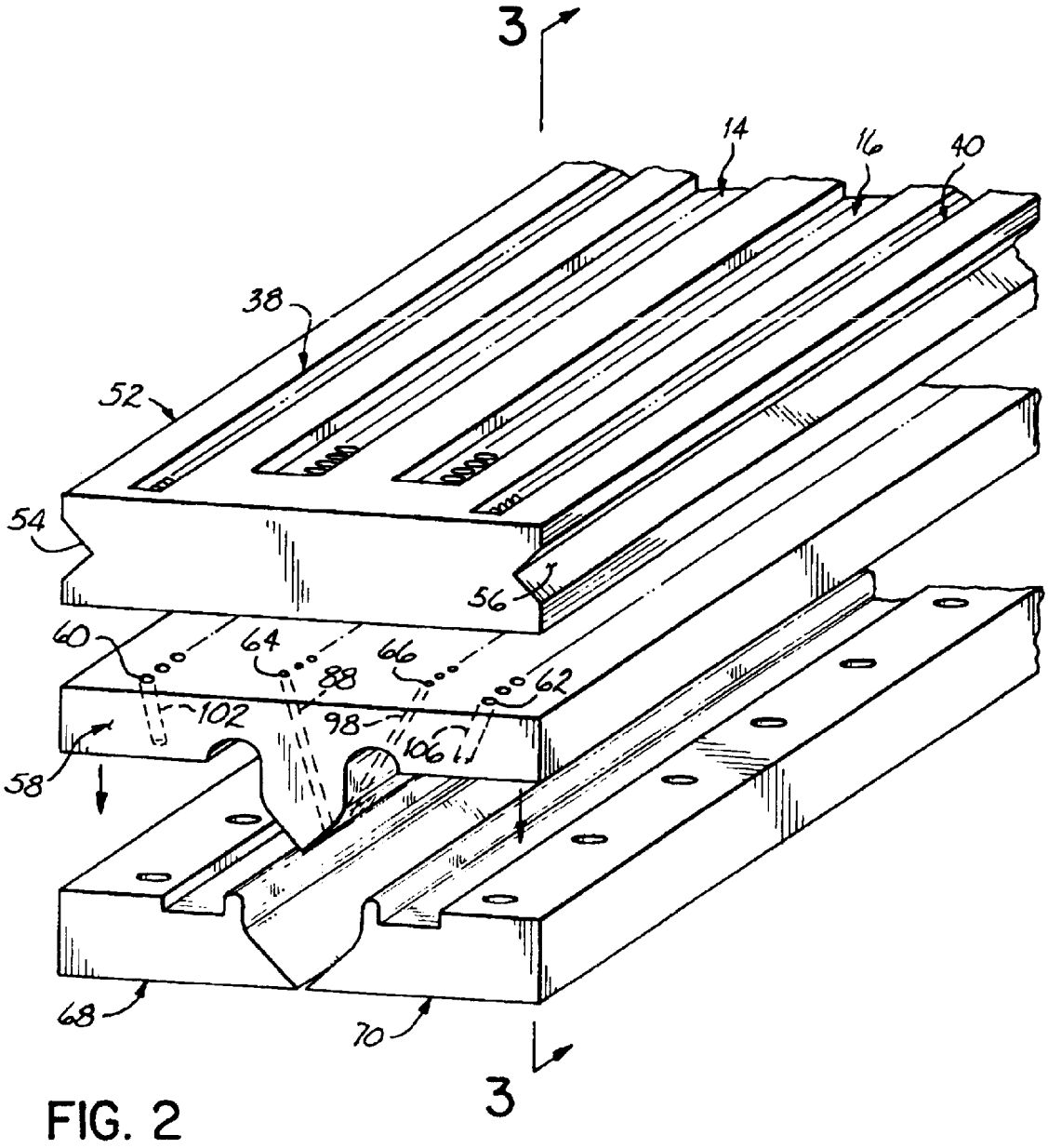
FIG. 2 is an exploded perspective view of one end of a spinpack of the melt spinning apparatus of FIG. 1 constructed in accordance with the invention for producing a multi-component filament.

With reference to FIG. 2, the spinpack 18 includes the filament producing features of the melt spinning apparatus 10. In particular, a transfer block 52 includes longitudinal side recesses 54, 56 for mounting the spinpack 18 to the manifold assembly 12. The transfer block 52 further includes the liquid inputs 14, 16 and air passage inputs 38, 40.

A die tip block 58, attached below the transfer block 52 to form a die tip, includes first and second rows of air passages 60, 62 and first and second rows of liquid passages 64, 66. A pair of air knife plates 68, 70 are attached below the die tip block 58.

Figure 3:
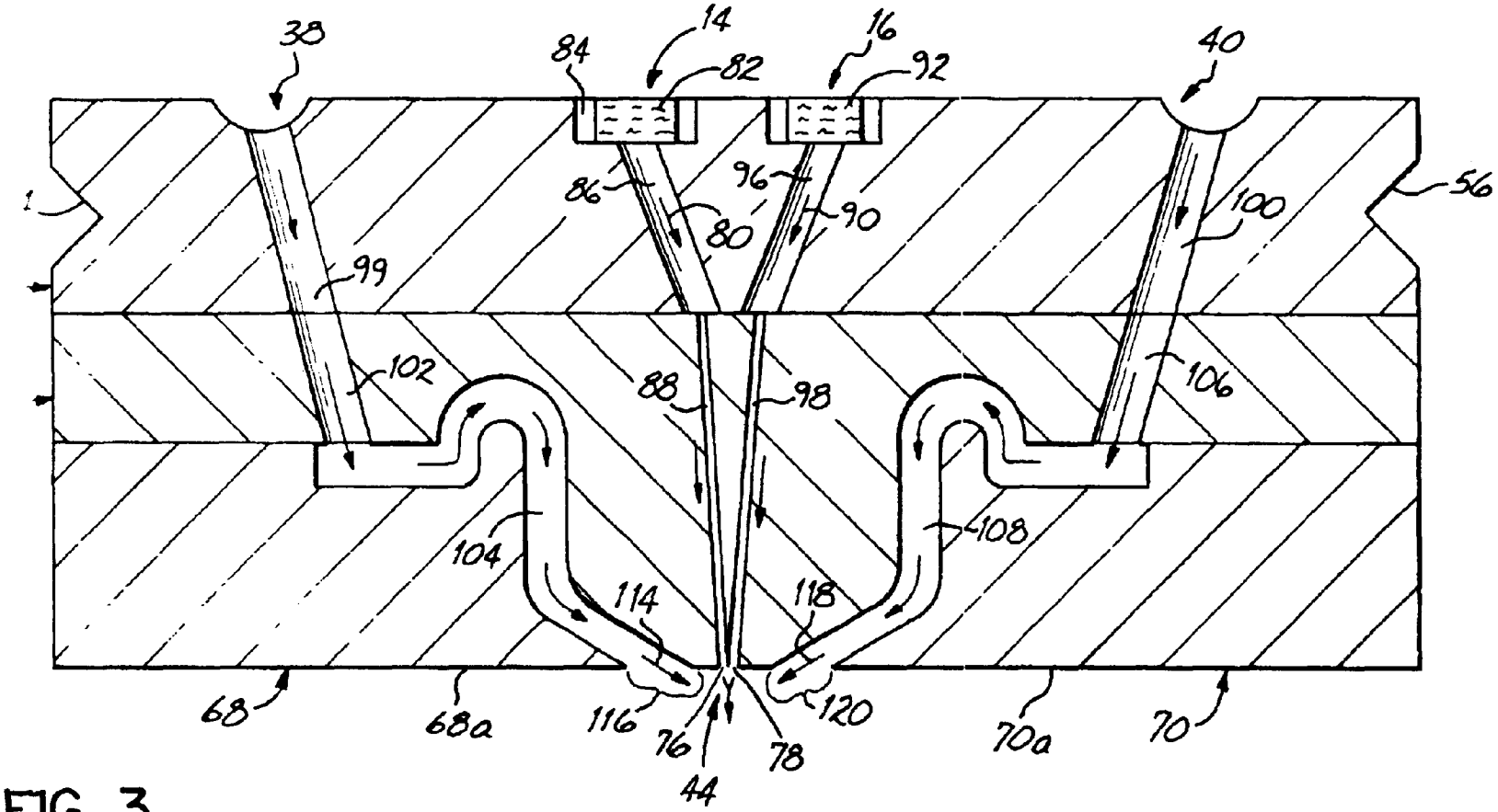
FIG. 3 is a cross-section taken generally along line 3—3 of FIG. 2, but illustrating the spinpack in assembled condition.
Figure 4:
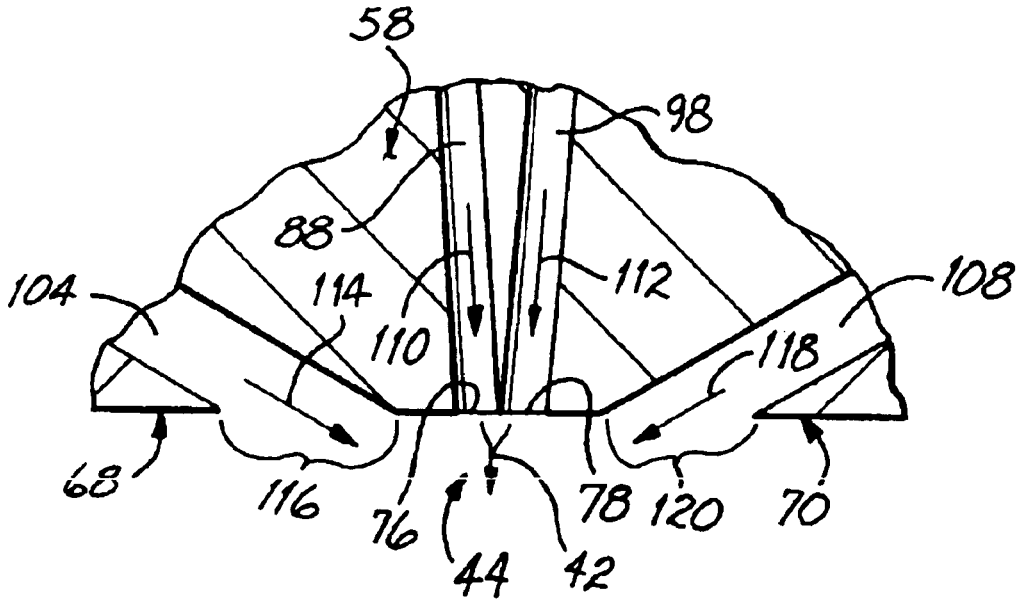
FIG. 4 is an enlarged cross-section of the discharge region of the die tip of the spinpack of FIG. 3.
Figure 5:
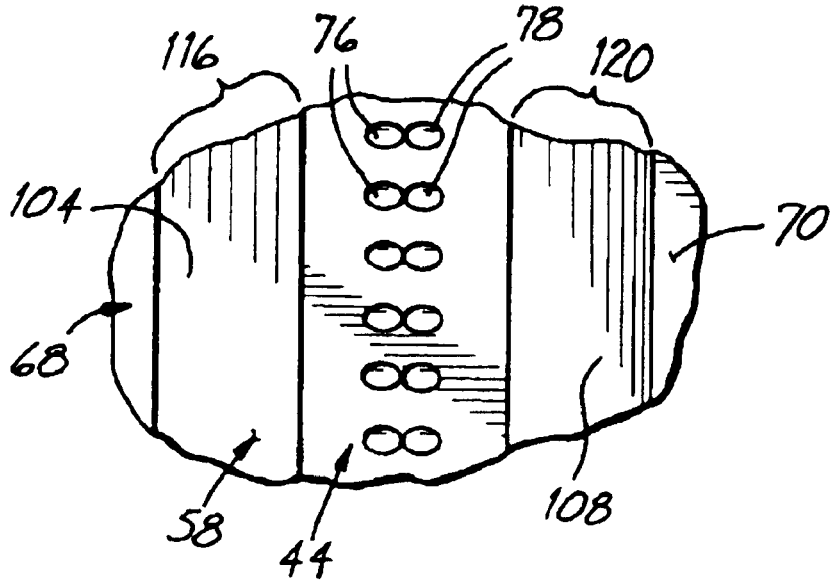
FIG. 5 is a partial bottom view of the assembled spinpack of FIG. 3.

With reference to FIGS. 3–5, the spinpack 18 is depicted in assembled condition showing how the process air and the two types of liquid material are brought together at each multi-component filament discharge outlet 44. The two types of liquid material (polymers A and B) are kept separate from one another in respective liquid passages 72, 74 throughout the entire spinpack 18 and are extruded separately. In particular, polymer A is extruded at a plurality of first outlets 76 and polymer B is extruded at a plurality of second outlets 78, each second outlet 78 adjacent to a corresponding one of the first outlets 76. Therefore, premature leakage of one liquid material into the other are avoided. In addition, each type of liquid material is advantageously maintained at a respective temperature for proper extrusion and post-extrusion combining of the two different liquid strands.

In particular, a supply of the first type of liquid material from the manifold assembly 12 enters the first liquid input 14 in the transfer block 52 of the spinpack 18 to form a first flow, such as at arrow 80. The first flow 80 encounters a first filter 82 disposed within a first filter recess 84 for entrapping contaminants. The first flow 80 continues through a first liquid transfer passage 86, which may be a single longitudinal slot or a series of passages each longitudinally aligned with one of the first outlets 76.

The die tip block 58 has a longitudinally aligned row of first die tip liquid passages 88 communicating between the first liquid transfer passage 86 in the transfer block 52 and with a respective one of the first outlets 76 in the die tip block 58.

Similarly, a supply of the second type of liquid material from the manifold assembly 12 enters the second liquid input 16 in the transfer block 52 of the spinpack 18 to form a second flow, such as at arrow 90. The second flow 90 encounters a second filter 92 disposed within a second filter recess 94 for entrapping contaminants. The second flow 90 continues through a second liquid transfer passage 96, which may be a single longitudinal slot or a series of passages each longitudinally aligned with one of the second outlets 78.

The die tip block 58 has a longitudinally aligned row of second die tip liquid passages 98 communicating between the second liquid transfer passage 96 in the transfer block 52 and with a respective one of the second outlets 78 in the die tip block 58.

The transfer block 52 includes a first air transfer passage 99 that communicates with the first air passage input 38 and a second air transfer passage 100 that communicates with the second air passage input 40.

The die tip block 58 includes a first die tip air passage 102 that communicates between the first air transfer passage 99 and a converging air channel 104 formed between the air knife plate 68 and the die tip block 58. Similarly, the die tip block 58 includes a second die tip air passage 106 that communicates between the second air transfer passage 100 and a converging air channel 108 formed between the air knife plate 70 and the die tip block 58.

With particular reference to FIG. 4, the first flow 80 is extruded from one of the first outlets 76 as a single-component strand 110 and the second flow 90 is extruded from one of the second outlets 78 as a single-component strand 112. The first and second strands 110, 112 thereafter combine together into a multi-component filament 42 having a side-by-side cross-sectional configuration of the two liquid components. Bonding or combining is promoted by the proximity of the first and second outlets 76, 78 and the converging orientation of the first and second die tip liquid passages 88, 98.

With particular reference to FIG. 5, each pair of adjacently positioned first and second outlets 76, 78 are shown to tangentially meet. Consequently, the strands 110, 112 do not contact one another or bond until after extrusion. Each outlet 76, 78 is oblong due to the nonperpendicular orientation of the corresponding die tip liquid passages 88, 98 with respect to a bottom, external surface of the die tip 58.

A first air jet 114 exits air channels 104 at a first spin slot 116 and is directed at the multi-component filament 42. A converging, second air jet 118 exits air channel 108 at a second spin slot 120 and is directed at the multi-component filament 42. The air jets 114, 118 cooperate to impinge and attenuate the filament 42.

Figure 6:
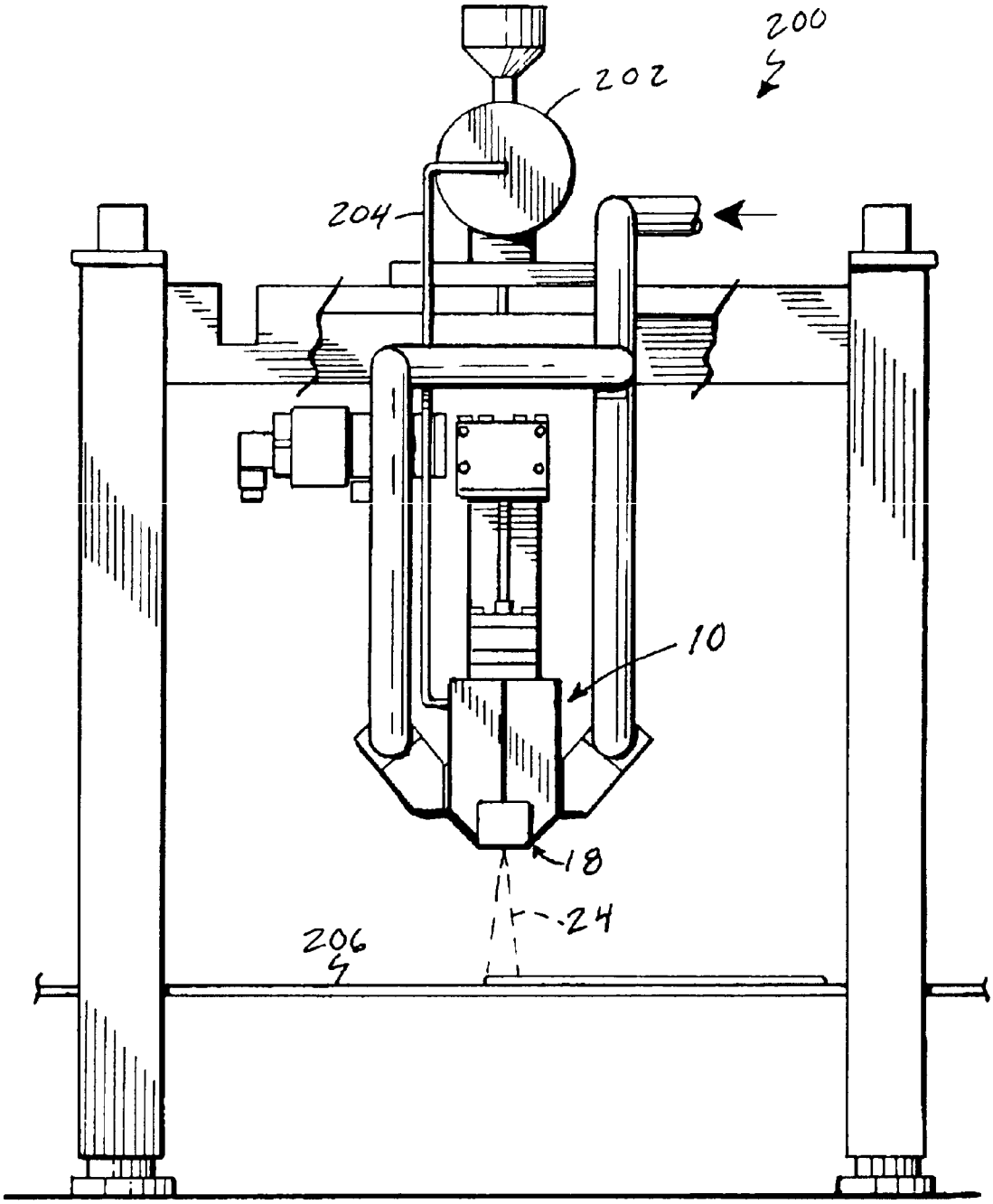
FIG. 6 is a diagrammatic view of a meltblown apparatus incorporating a meltspinning assembly of the present invention.

FIG. 6 illustrates a meltblown apparatus 200 using a spinpack 18 constructed in accordance with this invention. The apparatus 200 may be any suitable conventional meltblown apparatus or, for example, the apparatus disclosed in U.S. Pat. No. 6,182,732, assigned to the assignee of the present invention and the disclosure of which is hereby fully incorporated by reference herein. The apparatus 200 generally includes an extruder 202 with a polymer feedline 204 for feeding the first type of material to the meltspinning assembly 10. The second type of liquid material is also fed from a similar extruder and polymer feedline (not shown). The apparatus 200 is suitably supported above a substrate 206 or carrier for receiving the extruded multi-component filaments 42. The various other details of the apparatus are not described herein as these details will be readily understood by those of ordinary skill in the art.

Figure 7:
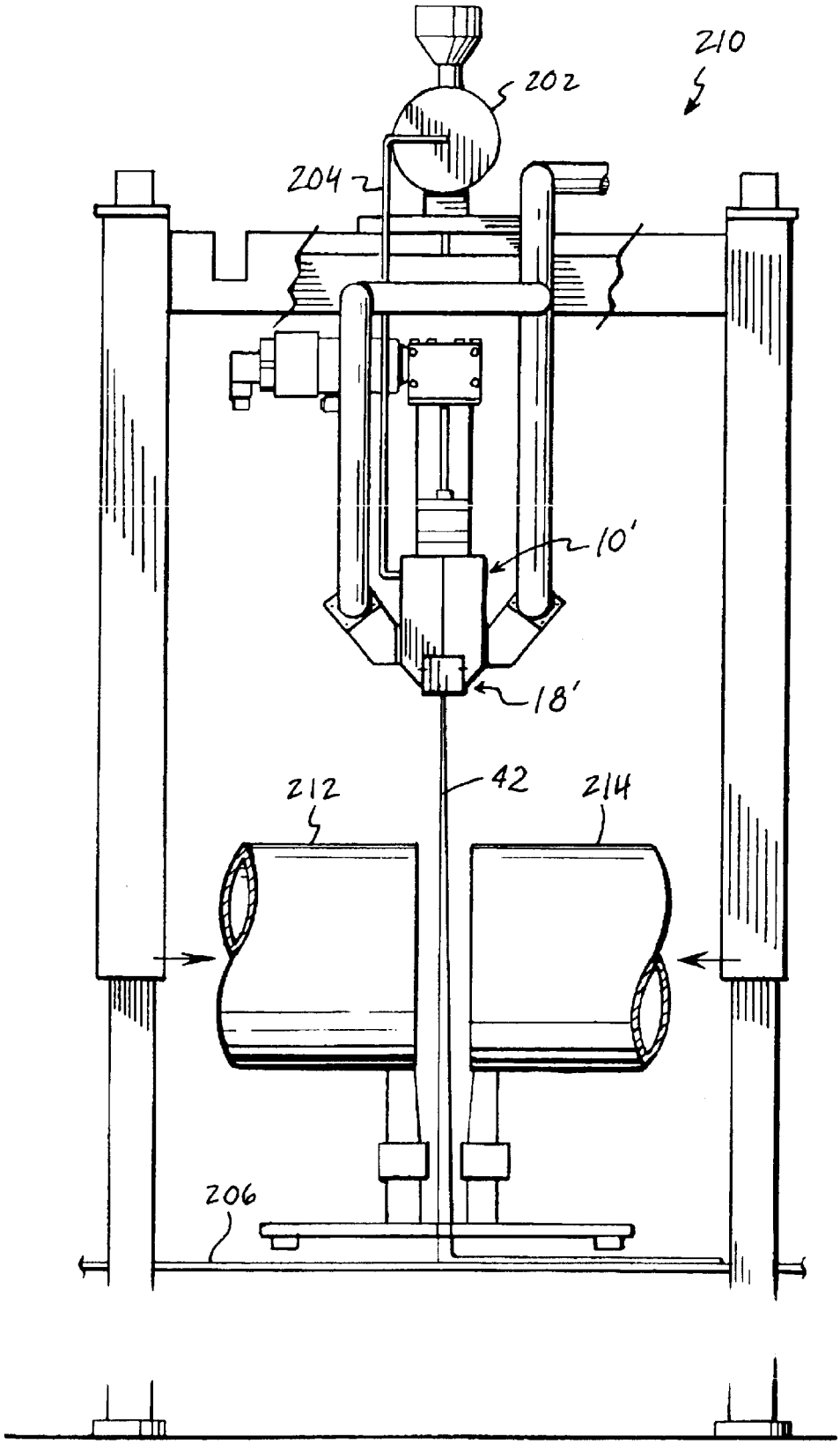
FIG. 7 is a diagrammatic view of a spunbond apparatus incorporating a meltspinning assembly of the present invention.

FIG. 7 illustrates a spunbond apparatus 210 using a melt spinning assembly 10' constructed in accordance with the invention, except that in the case of a spunbond operation, the spinpack 18' need not include components and air passages for delivering process air adjacent to the extruded multi-component filaments 42. Again, the spunbond apparatus 210 shown in FIG. 7 may be constructed in an otherwise conventional manner, such as disclosed in the above incorporated U.S. Pat. No. 6,182,732. This apparatus further includes air quenched ducts 212, 214 for purposes that will be readily understood by those of ordinary skill in the art. It will be understood that spinpack 18' may also be modified by those of ordinary skill to include multiple rows of multi-component filament discharge outlets.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

However, the invention itself should only be defined by the appended claims, wherein what is claimed is:

What is claimed is:

1. An apparatus for meltblowing a first type of liquid material into a first plurality of strands and a second type of liquid material into a second plurality of strands and combining the first and second pluralities of strands into a plurality of multi-component filaments, comprising:

a die tip including an external surface, a first liquid input configured to communicate with a supply of the first type of liquid material and a second liquid input configured to communicate with a supply of the second type of liquid material;

linear array of first liquid outlets each for extruding a corresponding plurality of first strands;

linear array of second liquid outlets each for extruding a corresponding plurality of second strands, each second outlet tangentially meeting with a corresponding one of said first liquid outlets at said external surface;

a plurality of first liquid passages, each communicating between said first liquid input and a selected one of said first liquid outlets;

a plurality of second liquid passages, each communicating between said second liquid input and a selected one of said second liquid outlets, said first and second liquid passages respectively converging at said first and second liquid outlets for respectively extruding the pluralities of first and second strands, the first and second strands combining together immediately after extrusion to form the plurality of multi-component filaments having a cross-sectional configuration combining the first and second types of liquid material; and air passages positioned on opposite sides of said first and second liquid outlets and configured to direct process air to impinge the multi-component filaments.

2. The apparatus of claim 1, further comprising:

a manifold assembly comprising first and second liquid passages, said first liquid passage adapted to communicate between the supply of the first type of liquid material and said first liquid input of said die tip, said second liquid passage adapted to communicate between the supply of the second type of liquid material and said second liquid input of said die tip, said manifold assembly further comprising first and second heating devices positioned proximate to said first and second liquid passages, said first heating device adapted to maintain the supply of the first liquid material at a first predetermined temperature and said second heating device adapted to maintain the supply of the second liquid material at a second predetermined temperature.

3. The apparatus of claim 1, wherein said die tip further comprises:

a transfer block including said first and second liquid inputs and portions of said first and second liquid passages; and a die tip block including said first and second liquid outlets and other portions of said first and second liquid passages.

* * * * *